US006332644B1

(12) United States Patent
Ito et al.

(10) Patent No.: US 6,332,644 B1
(45) Date of Patent: Dec. 25, 2001

(54) AUTOMOTIVE SUNSHADE PANEL AND METHOD OF MANUFACTURING SAME

(75) Inventors: Yuko Ito, Tokyo; Tomio Ito; Toshiji Akagi, both of Oyama; Masayuki Suda, Tatebayashi, all of (JP)

(73) Assignee: Showa Denko K.K., Tokyo (JP)

( * ) Notice: Subject to any disclaimer, the term of this patent is extended or adjusted under 35 U.S.C. 154(b) by 361 days.

(21) Appl. No.: 08/808,789

(22) Filed: Feb. 28, 1997

(30) Foreign Application Priority Data

Apr. 30, 1996 (JP) ..... 8-132652
Oct. 11, 1996 (JP) ..... 8-289306

(51) Int. Cl.[7] ..... B60J 7/00
(52) U.S. Cl. ..... 296/215; 296/214
(58) Field of Search ..... 296/215, 214, 296/191, 216.01, 900; 49/63; 428/31; 52/783.1, 783.14, 783.15, 783.17, 784.14, 383.11, 783.12, 783.19, 506.05, 662

(56) References Cited

U.S. PATENT DOCUMENTS

| | | | | |
|---|---|---|---|---|
| 1,625,061 | * | 4/1927 | Trout | 52/783.11 |
| 2,159,783 | * | 5/1939 | Dayes | 296/214 |
| 2,428,591 | * | 10/1947 | Slayter | 296/214 |
| 3,016,263 | * | 1/1962 | Rehmann | 296/214 |
| 3,033,608 | * | 5/1962 | Golde | 296/214 |
| 3,394,514 | * | 7/1968 | Lindner | 52/334 |
| 3,534,463 | * | 10/1970 | Molin et al. | 52/783.14 |
| 3,689,730 | * | 9/1972 | Campbell | 52/784.14 |
| 4,131,702 | * | 12/1978 | Alfter et al. | 296/214 |
| 4,175,785 | * | 11/1979 | Leiter | 296/214 |
| 4,274,672 | * | 6/1981 | Kuroda | 296/214 |
| 4,414,257 | * | 11/1983 | Haraga et al. | 428/182 |
| 4,650,244 | * | 3/1987 | Boots | 296/214 |
| 4,717,200 | * | 1/1988 | Kruger | 49/63 |
| 4,722,565 | * | 2/1988 | Kanou et al. | 296/214 |
| 4,890,880 | * | 1/1990 | Sakamoto | 296/214 |
| 4,981,290 | * | 1/1991 | Huyer | 296/214 |
| 5,207,258 | * | 5/1993 | Lennard | 160/130 |
| 5,326,615 | * | 7/1994 | Tsuchihashi et al. | 296/214 |
| 5,356,695 | * | 10/1994 | Mori et al. | 296/214 |
| 5,503,903 | * | 4/1996 | Bainbridge et al. | 296/214 |

FOREIGN PATENT DOCUMENTS

| | | | | |
|---|---|---|---|---|
| 2178377 | * | 2/1987 | (GB) | 296/214 |
| 67622 | * | 4/1986 | (JP) | 296/214 |
| 8-90080 | | 4/1996 | (JP) . | |

* cited by examiner

*Primary Examiner*—S. Joseph Morano
*Assistant Examiner*—Long Bao Nguyen
(74) *Attorney, Agent, or Firm*—Flynn, Thiel, Boutell & Tanis, P.C.

(57) ABSTRACT

According to the present invention, there is provided an automotive sunshade panel formed from a metallic hollow panel and having flanged edges and a two-dimensional curved surface or a three-dimensional curved surface formed at least partially of its central portion excepting the peripheries of the metallic hollow panel. For use in the present invention, a fabric may be laminated to at least one side of the metallic hollow panel. The metallic hollow panel is formed into a one-side inflated Roll-Bond panel, a both-side inflated Roll-Bond panel, a both-side flat three-layer Roll-Bond panel or a honeycomb panel.

In order to obtain such an automotive sunshade panel of the present invention, the metallic hollow panel is first bent in the roll circumferential direction (Y—Y axis) by means of twin rolls consisting of a rigid roll and an elastic roll, and then is subjected to a flanging process in which its longitudinal edges are flanged by press forming or roll forming. Alternatively, the metallic hollow panel may be first subjected to the flanging process in which its longitudinal edges are flanged by press forming or roll forming, and then be bent in the roll circumferential direction (Y—Y axis) by means of the twin rolls consisting of the rigid roll and the elastic roll. For this manufacture, the above hollow panel may carry fabrics laminated to at least one side thereof.

10 Claims, 4 Drawing Sheets

(a)

(b)

(a)

(b)

(c)

(d)

AUTOMOTIVE SUNSHADE PANEL AND METHOD OF MANUFACTURING SAME

BACKGROUND OF THE INVENTION a) Field of the Invention

The present invention relates to an automotive sunshade panel formed from a hollow panel having a two-dimensional or three-dimensional curved surface conforming to a bent curved surface in the form of the top of an automobile, and to a method of manufacturing such an automotive sunshade panel.

b) Description of the Prior Art

To manufacture a bent panel having a large radius of curvature such as an interior side sunshade panel for an automotive sunroof, in the prior art techniques, the pressed body obtained from press work using dies and reinforcing members such as ribs were assembled together by bonding means including spot welding, riveting, adhesion, etc, since typical roll-based bending work often gave birth to spring back resulting in a dimensional instability. Japanese Patent Laid-open Pub. No. 96-90080 discloses a method of manufacturing through bulging a bent panel having inflations serving as reinforcing ribs from an aluminum Roll-Bond panel stock. For the manufacture of the bent panel, in the above invention, use was made of a forming machine provided with a forming surface having a curved surface of a radius of curvature to be formed. A planar stock is disposed on the forming machine. A punch holder of the forming machine is then lowered to chuck the peripheries of the planar stock. With the peripheries being chucked, the planar stock is finally brought into abutment against the forming surface. In the case of press forming an automotive sunshade panel by means of dies as in those conventional methods, however, a multiplicity of dies corresponding to various types of vehicles are required, and hence relatively small-lot products result uneconomically in a relative increase of cost used up by the dies.

Furthermore, the invention described in the above publication uses an aluminum Roll-Bond panel as stock. This stock tends to bring about a decrease in the gauge direction with a forming force during the press forming, as well as deficiencies such as collapse of the inflated portions. Although fabrics are typically laminated to the automotive sunshade panel, they must be laminated to the curved surface after pressing since lamination before pressing may possibly allow the fabrics to peel off under the action of lubricant used in the pressing process. This resulted in increased number of working steps and was costly.

Typical stock for the automotive sunshade panel can be a thermoset resin sheet, a steel sheet, or an aluminum sheet, with a recent attention paid to the aluminum sheet (including aluminum alloy sheet) in terms of its lightweight and recyclability. In view of rigidity and cost-saving, the aluminum sheet has a gauge of the order of 0.8 to 1.0 mmt for pressing process. On the contrary, it has been hitherto known to bend the stock by use of twin rolls consisting of a metal roll and a resin roll as shown in FIG. 2. In the case of bending the aluminum sheet of the order of 0.8 to 1.0 mmt in gauge by using the above metal/resin roll pairs serving as rigid/elastic roll pairs, it would be possible to perform bending with a relatively small radius of curvature, but impossible to bend the stock having a relatively large radium of curvature of the order of 2500 to 10000 mm due to the influence of the spring back. Thus, the reinforcing members such as ribs become indispensable and the configuration is unstable, leaving unsolved the problems including dependence on the press forming and fabric lamination after press forming.

SUMMARY OF THE INVENTION

It is therefore an object of the present invention to provide an automotive sunshade panel and a method of manufacturing the same which have overcome the above problems involved in the prior art techniques.

Another object of the present invention is to obtain an automotive sunshade panel by use of means capable of coping with a wide variety of types of vehicles through a simple method without additional processes such as bulging with expensive dies, as well as means extremely effective for the manufacture of products in relatively small lots.

The other objects of the present invention will become apparent from the following detailed description.

The present inventors hardly researched an approach to use of twin rolls consisting of a rigid roll and an elastic roll as shown in FIG. 2 to form aluminum panel stocks having large radii of curvature such as automobile sunshade panels. As a result of this, we reached a knowledge that use of hollow panels as the aluminum stocks would enable two-dimensional or thee-dimensional bending process to be relatively easily performed by means of the twin rolls consisting of the rigid roll and elastic roll, without giving rise to any reduction in the panel gauge direction which may often occur in the press forming process. The present invention was conceived based on such a knowledge.

Thus, according to the present invention, there is provided an automotive sunshade panel having longitudinal flanged edges and having a two-dimensional or three-dimensional curved surface formed at least partially of the central part excepting the peripheries of the metallic hollow panel. For use in the present invention, a fabric may be laminated to at least one side of the hollow panel. The metallic hollow panel can be formed into a one-side inflated Roll-Bond panel, a two-side inflated Roll-Bond panel, a both-side flat three-layer Roll-Bond panel or a honeycomb panel.

In order to obtain such an automotive sunshade panel of the present invention, the metallic hollow panel is first bent in the roll circumferential direction (Y—Y axis) by means of twin rolls consisting of a rigid roll and an elastic roll, and then is subjected to a flanging process in which its longitudinal edges are flanged by press forming or roll forming. Alternatively, the metallic hollow panel may be first subjected to the flanging process in which its longitudinal edges are flanged by press forming or roll forming, and then be bent in the roll circumferential direction (Y—Y axis) by means of the twin rolls consisting of the rigid roll and the elastic roll. For this manufacture, the above hollow panel may carry fabrics laminated to at least one side thereof. The hollow panel can be a one-side inflated Roll-Bond panel, a both-side inflated Roll-Bond panel, a both-side flat three-layer Roll-Bond panel or a honeycomb panel. Upon the execution of bending process in the roll circumferential direction (Y—Y axis) by means of the twin rolls consisting of the rigid roll and the elastic roll, there may be used as the twin rolls so-called crown rolls, that is, cambered rolls having curvatures in the roll axial direction, so as to achieve bending in the roll axial direction (X—X axis) in addition to the bending in the roll circumferential direction (Y—Y axis) to consequently effect three-dimensional bending.

DESCRIPTION OF THE PREFERRED EMBODIMENTS

Figure 1:
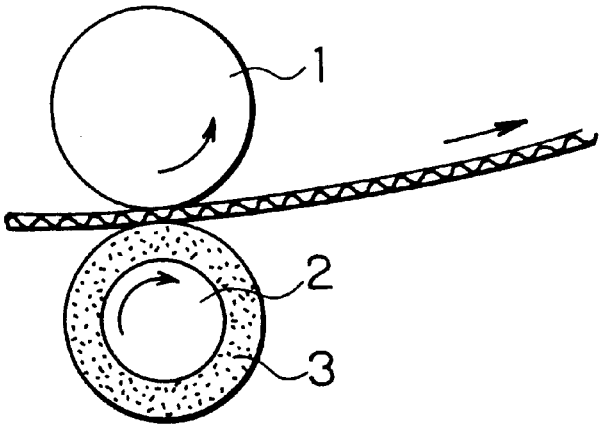
FIG. 1 is an explanatory diagram of a bending process in accordance with the present invention, depicting sheet stock bending process by means of twin rolls consisting of a rigid roll and an elastic roll.
Figure 2:
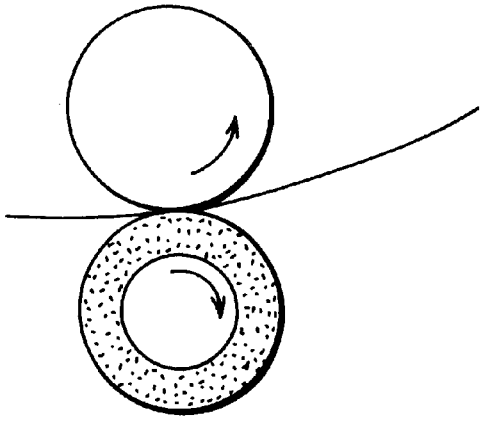
FIG. 2 is an explanatory diagram of a principle of the sheet stock bending process by means of the twin roll consisting of the rigid roll and the elastic roll.

FIG. 1 is an explanatory view showing an example of a method of forming a hollow panel curved surface in accordance with the present invention. In FIG. 1, reference numeral 1 denotes a metal roll serving as a rigid roll, and reference numeral 2 denotes a resin roll serving as an elastic roll. The surface of the resin roll 2 is coated with an elastic material, typically an urethane rubber layer 3. The metal roll 1 is first lowered to press against the urethane rubber roll surface 3. When a hollow panel is then passed through the nip between the two rolls under such a condition, it is bent in the roll circumferential direction (Y—Y axis) at a radius of curvature along a depression area R formed in the urethane having an elasticity.

In this case, the hardness of the urethane resin can be 50 to 90 degrees, preferably 55 to 65 degrees. The roll gap and compression ratio may be varied to achieve a desired radius of curvature. It is to be appreciated that there can also be obtained a continuously curved surface or a trapezoidal surface through two point bending due to partial release of the compressive force. For the bending in the roll circumferential direction (Y—Y axis), the radius of curvature is typically of the order of 1000 to 15000 mm, whereas for the trapezoidal bending, the radius of curvature is typically of the order of 150 to 300 mm.

Figure 8:
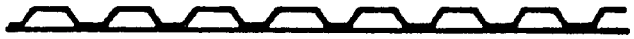
FIGS. 8(*a*) to 8(*d*) are explanatory diagrams in section of hollow panels for use in the present invention, depicting respectively a one-side inflated Roll-Bond panel, a both-side inflated Roll-Bond panel, a both-side flat three-layered Roll-Bond panel and a honeycomb panel.
Figure 8:
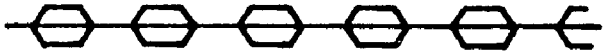
Figure 8:
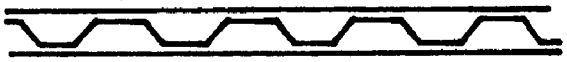
Figure 8:
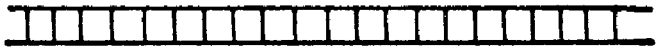

Used as a hollow panel to be formed is a panel having hollow portions within its interior and consisting of two or three sheet stocks as shown in FIG. 8(*a*) to FIG. 8(*d*).

A one-side inflated Roll-Bond panel shown in FIG. 8(*a*) is formed as follows. Two aluminum sheets are prepared at first for the process in which they are subjected to the steps of: chemically removing a harmful fat or stain from their surfaces; and mechanically removing therefrom an oxide layer by using a wire brush so that their fresh surfaces are exposed to the following treatments. A bond inhibitor, which is applied to such a fresh surface of at least one aluminum plate, covers its areas of a predetermined pattern where the reinforcing ribs are to be formed. An ink composed mainly of colloidal graphite having a particle diameter of 1 um or less is used in general as the bond inhibitor, and is usually applied to said surface by the printing technique.

Then, two aluminum sheets are overlaid upon one another such that the surface carrying the bond inhibitor is closed. Subsequently, they are hot rolled by rolls and under a condition which can ensure a sufficient strength of the bonded plates. The sheets are tightly consolidated and from a single panel, with areas printed with the inhibitor however remaining unbonded. After cold rolled and annealed if necessary, a compressed fluid such as a compressed air is forced from a side edge into clearances, which are present between the plates on their areas where the bond inhibitor exists. The areas of the predetermined pattern are inflated in this manner so that the thus expanded hollow portions protrude inwards in a roll bonded panel. This panel has thus no lugs or protrusions on its outer surface, but has only on its inner surface the reinforcing ribs of a desired height and cross-sectional shape. This process may therefore be called "one-side inflation" process.

In manufactures of the roll bonded panel, it is important to maintain during and after the single-sided inflation the good flatness of unexpanded outer surface. To obtain these requirements, it is preferable to apply the outer aluminum plate which is made of a heat-treatable aluminum alloy.

In order to form a both-side inflated Roll-Bond panel as shown in FIG. 8(*b*), three sheet stocks are used and patterned areas are provided on both sides of the intermediate sheet stock and then inflated. A both-side flat three-layer Roll-Bond panel as shown in FIG. 8(*c*) is formed by providing alternate patterns on both sides of the intermediate of three sheet stocks so as to obtain planar exterior surfaces. A honeycomb panel as shown in FIG. 8(*d*) includes a plurality of sheet stocks arranged in a so-called honeycomb form between top and bottom sheet stocks. The channel patterns of such hollow panels are not intended to be limited to any specific ones.

In the case of using as the hollow panel the one-side inflated Roll-Bond panel shown in FIG. 8(*a*), it is preferable that it be passed through the nip between the two rolls so that its flat side come into contact with the rigid (metal) roll with its inflated side coming into contact with the elastic (resin) roll. In the case where the hollow panel is the both-side inflated Roll-Bond panel as shown in FIG. 8(*b*) or the both-side flat three-layer Roll-Bond panel as shown in FIG. 8(*c*) or the panel as shown in FIG. 8(*d*), either side of the hollow panel may abut against the rigid (metal) roll. Copper, aluminum or the like can be used as the metallic material for the hollow panel of the present invention. In the case of using aluminum, the hollow panel should be of annealed or partial-annealed. The present invention will hereinafter be described for the aluminum hollow panel, but it is natural that the same apply to the copper panel. Additionally, the original sheet stocks for the hollow panel of the present invention may be multi-cavity molded.

Figure 3:
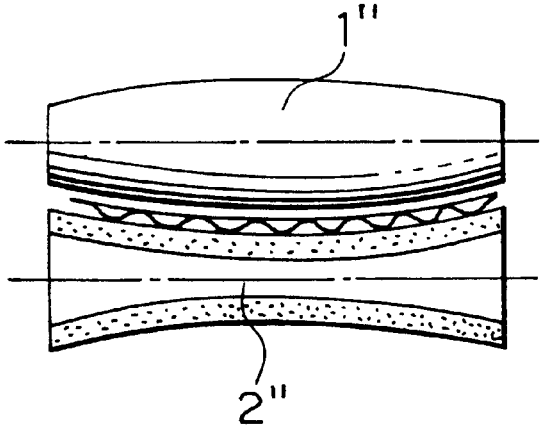
FIG. 3 is an explanatory diagram of the sheet stock bending process by means of a cambered twin rolls consisting of a rigid roll and an elastic roll.
Figure 4:
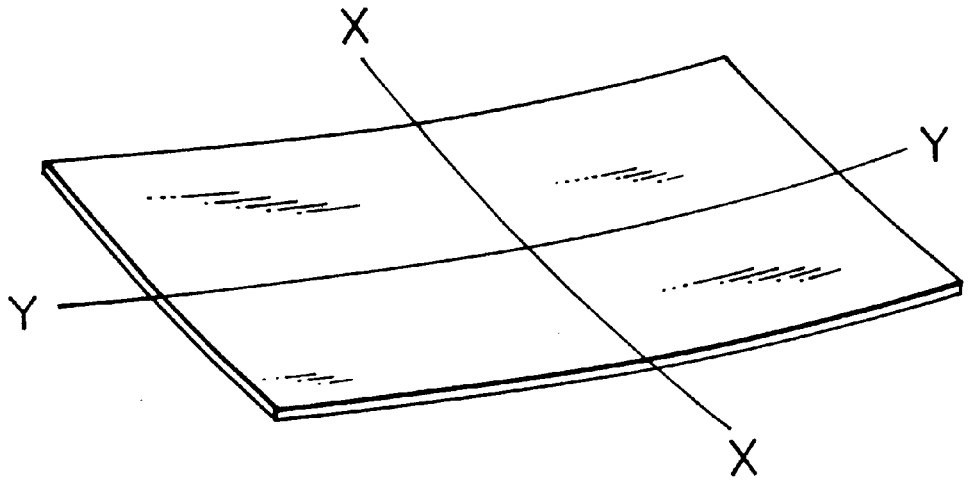
FIG. 4 is a schematic explanatory diagram of a three-dimensionally bent sheet stock.
Figure 5:
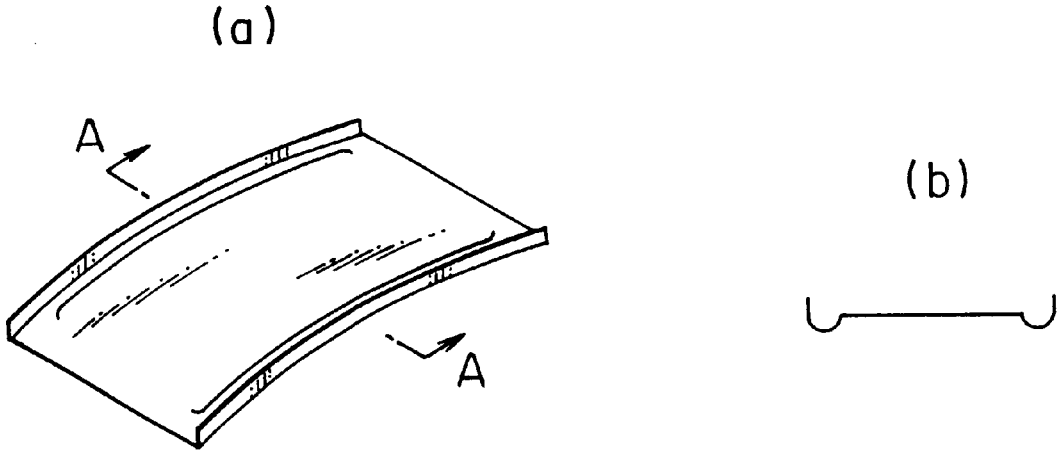
FIGS. 5(*a*) and 5(*b*) are explanatory diagrams in perspective view and in sectional view taken along a line A—A of FIG. 5(*a*), respectively, showing a flanging process in accordance with the present invention and a resultant hollow panel.

FIG. 5 illustrates cambered rolls 1" and 2" whose roll forming surfaces have curvatures, for use as the twin rolls comprising metal/resin rolls serving as rigid/elastic rolls. Use of such cambered rolls provides a sunshade panel having a radius of curvature in the roll axial direction (X—X axis), thereby achieving three-dimensional bending as shown in FIG. 4 in cooperation with the bending in the roll circumferential direction (Y—Y axis). For imparting radii of curvature to the roll forming surfaces as shown in FIG. 3, the forming surface of the rigid (metal) roll 1" may be convexed with the elastic (resin) roller 2" having a concave surface, and vice versa. Preferably, as shown, the rigid (metal) roll 1 has a convex surface. A curvature R of bending in the roll axial direction (X—X axis) is typically 2000 mm or more. When used as the sunshade panel, the size of the hollow panel is about 300 to 1000 mm in width and about 600 to 1000 mm in length.

Subsequent to the two-dimensional or three-dimensional bending process by means of the twin rolls comprising the rigid/elastic rolls, the hollow panel is subjected to a flanging process which includes bending both edges of the hollow panel into concaved or U-shaped sections as shown in FIG. 5 by means of press working or roll forming. Such flanging process will ensure a formation of the hollow panel presenting embossing effect. The flanging process not only has an effect of enhancing the plate rigidity, but also is indispensable as safety measures in order to prevent plate cut surfaces from injuring a driver or fellow passengers. In addition, bending of the edges into the concaved or U-shaped sections will avoid rising of panel's curved central portion above the edges, thereby obviating, when the sunshade panel is pulled out of the cabinet, a possibility of the curved central portion coming into frictional contact with the interior material to give birth to static electricity resulting in contamination of the panel surfaces due to adhesion of dust or the like.

Figure 6:
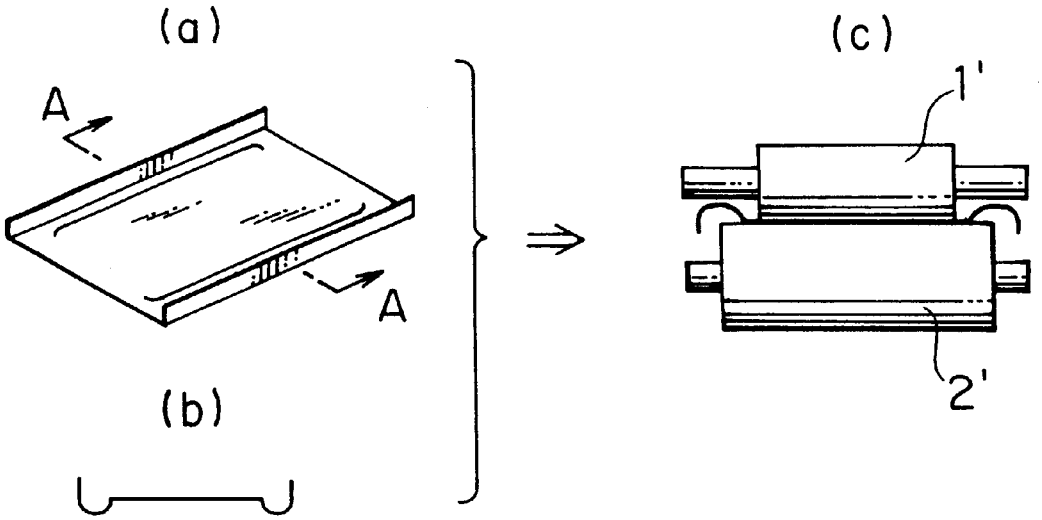
FIGS. 6(*a*), 6(*b*) and 6(*c*) are explanatory diagrams showing another process of the method of the present invention, FIG. 6(*a*) depicting a flanged hollow panel, FIG. 6(*b*) being a sectional view of FIG. 5(*a*) taken along a line A—A, and FIG. 6(*c*) depicting the flanged hollow panel being subjected to a process of bending in the roll circumferential direction (Y—Y axis) by means of the twin rolls.

FIG. 6 illustrates another example of the method in accordance with the present invention. In this example, a hollow panel first undergoes a flanging process in which its longitudinal edges are bent into concaved or U-shaped sections by means of press working or roll forming (FIGS. 6(*a*) and 6(*b*)). Use is then made of twin rolls as shown in FIG. 6(*c*) consisting of a rigid roll 1' made of metal, wood, or the like having a width slightly smaller than that of the planar central portion of the flanged hollow panel, and an elastic roll 2' having a surface coated with urethane or the like and a width larger than that of the rigid roll 1'. This method also ensures the acquisition of substantially the same formed article as that shown in FIG. 5. By virtue of the planar hollow panel flanging, the die production cost in the FIG. 6 forming method is further reduced as compared with the FIG. 5 method. In this case, a panel centrally having a three-dimensional curved surface can be obtained if cambered rolls 1" and 2" having roll forming surfaces with curvatures are used as the twin rolls comprising rigid/elastic rolls. Although the present invention employs the metal roll and resin roll as the rigid roll and elastic roll, respectively, the combination of the rigid/elastic rolls is not intended to be limited to the combination of the metal/resin rolls and any combination is available as long as the roll surfaces have rigidity/elasticity. The present invention will thus provide automotive sunshade panels each having longitudinal edges of concaved or U shape in section and having an embossed central portion in the form of a continuous curved surface, a trapezoidal curved surface or a three-dimensional curved surface. Those automotive sunshade panels may be manufactured by either of the two methods set forth hereinabove.

Prior to the rolling process, a fabric may be laminated onto the hollow panel. Due to a relatively small pressure used for the forming process in the method of the present invention, the fabric will not be damaged in spite of pre-forming lamination of the fabric onto the hollow panel. An increase in production costs is thus prevented which may arise from skillful work necessary for post-forming fabric lamination on curved surfaces as in the prior art.

Embodiment 1

The following test specimens A to D of the hollow panel were subjected to the roll forming process in accordance with the present invention.

Test Specimen A: one-side inflated Roll-Bond panel; pre-inflation gauge 1.2 (0.6×2) A1100-O Test Specimen B: both-side inflated Roll-Bond panel; pre-inflation gauge 1.2 (0.6×2) A1100-O Test Specimen C: both-side flat Roll-Bond panel; pre-inflation gauge 1.2 (0.4×3) A1100-O Test Specimen D: both-side flat honeycomb panel; overall gauge 3.8 (0.4+3+0.4) A1100-H24

The test specimens were each dimensioned to be 400×750 mm and the test specimens having fabric laminated surfaces were also tested. By use of a rubber-based spray-type adhesive, for fabric lamination, a thick close-woven wool fabric of 1 mmt in thickness is laminated on the flat surface, with a non-woven fabric of 0.2 mmt in thickness laminated on the patterned surface. Used as the upper roll and the lower roll were a metal roll (roll diameter: 65 mm) and an urethane resin roll (roll diameter: 160 mm; hardness: 60 degrees), respectively. At an operating speed of 7 m/ min, two dimensional bending process was carried out and then followed by the flanging process. Table 1 shows results of the pre/post-bending sheet gauge and bending curvature for each of the specimens.

TABLE 1

| TEST SPECIMEN | SHEET GAUGE | SHEET OVERALL THICKNESS | FABRIC LAMINATION | BENDING CURVATURE (Y—Y AXIS) | POST-BENDING OVERALL THICKNESS | EXTERNAL APPEARANCE |
|---|---|---|---|---|---|---|
| A | 0.6t × 2 mm | 3.0 mmt | absent | 5,000 mm | 2,8 mmt | excellent |
| B | 0.6t × 2 mm | 4.0 mmt | absent | 5,000 mm | 3.8 mmt | excellent |
| C | 0.4t–0.2 mm | 3.0 mmt | absent | 5,000 mm | 2.8 mmt | exrellent |
| D | 0.4t–2 mm | 3.8 mmt | absent | 5,000 mm | 3.6 mmt | excellent |
| A | 0.6t × 2 mm | 3.0 mmt | present | 5,000 mm | 2.8 mmt | excellent |
| B | 0.6t × 2 mm | 4.0 mmt | present | 5,000 mm | 3.8 mmt | excellent |
| C | 0.6t × 2 mm | 3.0 mmt | present | 5,000 mm | 2.8 mmt | excellent |
| D | 0.4–0.2 mm | 3,8 mmt | present | 5,000 mm | 3.6 mmt | excellent |

*Sheet overall thickness and post-bending overall thickness exclude thickness of fabric.
*Test specimen D includes a 0.4 mm skin and a 0.2 mm cell.

Embodiment 2

Figure 7:
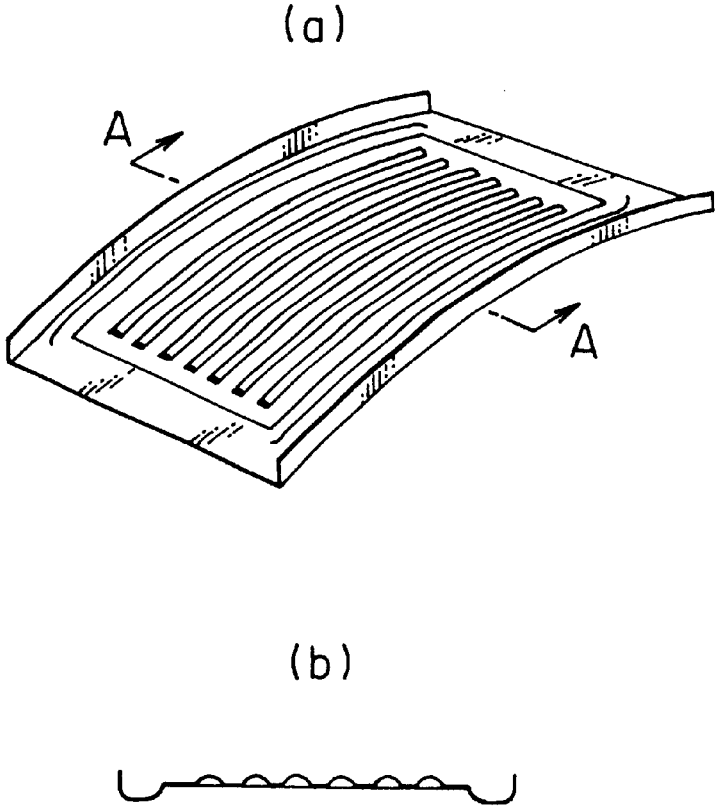
FIG. 7 illustrates a two-dimensionally bent automotive sunshade panel of the present invention obtained by the process shown in FIG. 6.

In accordance with the steps shown in FIG. 6, the test specimens A to D tested in the Embodiment 1 were first subjected to the pressing process to bend the hollow panel edges into U-shaped sections. They were then subjected to the two-dimensional bending process by means of the twin rolls shown in FIG. 6(*b*). The execution of these steps resulted in a two-dimensionally bent automotive sunshade panel having substantially the same flanging form as shown in FIG. 7.

Embodiment 3

The test specimens A to D tested in the Embodiment 1 were subjected to three-dimensional bending process in the same manner except for the use of the cambered rolls as the upper and lower rolls. The upper metal roll 1" had a convex crown of 10,000 mm in radius of curvature, and the lower urethane resin roll 2" had a concave crown of 10,000 mm in radius of curvature. The results are shown in Table 2. After the execution of the three-dimensional bending process, the hollow panels were subjected to the flanging process.

TABLE 2

| TEST SPECIMEN | SHEET GAUGE (mmt) | SHEET OVERALL THICKNESS (mmt) | FABRIC LAMINATION | BENDING CURVATURE (X—X AXIS) (mm) | BENDING CURVATURE (Y—Y AXIS) (mm) | POST-BENDING OVERALL THICKNESS (mm) | EXTERNAL APPEARANCE |
|---|---|---|---|---|---|---|---|
| A | 0.6t × 2 | 3.0 | absent | 2,500 | 10,000 | 2,5 | excellent |
| B | 0.6t × 2 | 4.0 | absent | 2,500 | 10,000 | 3.8 | excellent |
| C | 0.6t × 2 | 3.0 | absent | 2,500 | 11,000 | 2.3 | excellent |
| D | 0.4–0.2 | 3.8 | absent | 2,500 | 11,000 | 3.2 | excellent |
| A | 0.6t × 2 | 3.0 | present | 2,500 | 10,000 | 2.6 | excellent |
| B | 0.6t × 2 | 4.0 | present | 2,500 | 10,000 | 3.4 | excellent |
| C | 0.6t × 2 | 3.0 | present | 2,500 | 11,000 | 2.4 | excellent |
| D | 0.4–0.2 | 3,8 | present | 2,500 | 11,000 | 3.2 | excellent |

*Sheet overall thickness and post-bending overall thickness exclude thickness of fabric.
*Test specimen D includes a 0.4 mm skin and a 0.2 mm cell.

The results of Table 1 revealed that adjustment of the roll gap enabled curved surfaces having arbitrary radii of curvature to be obtained in the two-dimensional bending. Although the tolerances may be influenced by variability in overall thickness of the Roll-Bond inflation, it is envisaged that there is no problem as long as the inflation thickness tolerances lie within the range of ±0.1 mm. The results of Table 2 has proved that the R dimensions of the three-layered Roll-Bond panels lie within permissible tolerances in terms of design R dimensions of products although the three-dimensional bending presents a somewhat larger radius of curvature than the R of the roll crown due to differences in structural rigidity of the stocks. Since the test specimens C and D have higher rigidities than those of the test specimens A and B, the Y—Y axis R may becomes large to some extent if conformed to 2,500 mm of X—X axis R, which would however be within the design permissible tolerances. The above test results have thus ensured that the resultant hollow panels entail no problems in terms of form and are conveniently suitable as automotive sunshade panels.

Thus, according to the present invention, by virtue of the adoption of the metallic, in particular aluminum hollow panels, there can be obtained automotive sunshade panels, which meet requirements therefor, having a two-dimensional curved surface of 5000 mm in Y—Y axis R or having a three-dimensional curved surface of 5000 mm in Y—Y axis R and of 2000 mm in X—X axis R, at reduced production costs due to no need for any specific dies and without requiring conventional reinforcing ribs for stabilizing the curved surfaces due to substantially no occurrence of spring back. In addition, capability of executing the rolling process under a small pressure allows the use of hollow panels to which fabrics have been previously laminated with the panels flat, which will provide a remarkable improvement in fabric laminating workability. Moreover, due to capability of forming the panels having arbitrary two-dimensional or three-dimensional radii of curvature by altering the roll gap, roll pressure or the like, as well as due to capability of shaping the panels into trapezoidal form, there can be obtained automotive sunshade panels having curved surfaces feasible for multiple-type and small-lot productions, and a method of manufacturing the same.

What is claimed is:

1. An automotive sunshade panel comprising a metallic hollow panel having longitudinal edges and flanged portions provided along the longitudinal edges, the metallic hollow panel having a two-dimensionally curved surface formed at a central portion thereof and comprising first and second metal sheet members, said first metal sheet member being provided above said second metal sheet member and directly bonded thereto to form a plurality of segregated, longitudinally extending, parallel passageways therebetween.

2. An automotive sunshade panel comprising a metallic hollow panel having longitudinal edges and flanged portions provided along the longitudinal edges, the metallic hollow panel having a three-dimensionally curved surface formed at a central portion thereof and comprising first and second metal sheet members, said first metal sheet member being provided above said second metal sheet member and directly bonded thereto to form a plurality of segregated, longitudinally extending, parallel passageways therebetween.

3. The automotive sunshade panel of claim 1, wherein the metallic hollow panel comprises a third metal sheet member provided below and directly bonded to said second metal sheet member to form a plurality of segregated, longitudinally extending, parallel passageways therebetween.

4. The automotive sunshade panel of claim 2, wherein the metallic hollow panel comprises a third metal sheet member provided below and directly bonded to said second metal sheet member to form a plurality of segregated, longitudinally extending, parallel passageways therebetween.

5. The automotive sunshade panel of claim 1, wherein a fabric is laminated to at least one side of the hollow panel.

6. The automotive sunshade panel of claim 2, wherein a fabric is laminated to at least one side of the hollow panel.

7. The automotive sunshade panel of claim 5, wherein said passageways are provided on only one side of the hollow panel.

8. The automotive sunshade panel of claim 6, wherein said passageways are provided on only one side of the hollow panel.

9. The automotive sunshade panel of claim 3, wherein said first and third metal sheets are flat and disposed in parallel relationship with respect to one another.

10. The automotive sunshade panel of claim 4, wherein said first and third metal sheets are flat and disposed in parallel relationship with respect to one another.

* * * * *